US006225970B1

(12) United States Patent
Song et al.

(10) Patent No.: US 6,225,970 B1
(45) Date of Patent: May 1, 2001

(54) SYSTEM FOR DRIVING HIGH-RESOLUTION DISPLAY PANEL AND METHOD THEREOF

(75) Inventors: Keun Bok Song; Jong Hwa Won, both of Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/212,576

(22) Filed: Dec. 16, 1998

(30) Foreign Application Priority Data

Dec. 17, 1997 (KR) ..... 97-69435

(51) Int. Cl.[7] ..... G09G 3/36

(52) U.S. Cl. ..... 345/103; 345/204; 345/508; 345/502

(58) Field of Search ..... 345/103, 1, 3, 345/508, 507, 502

(56) References Cited

U.S. PATENT DOCUMENTS 4,740,786 * 4/1988 Smith ..... 345/3
4,842,371 * 6/1989 Yasuda et al. ..... 345/96
4,878,194 * 10/1989 Nakatsugawa et al. .
4,985,698 * 1/1991 Mano et al. ..... 345/103
5,040,874 * 8/1991 Fukuda ..... 345/87
5,157,386 * 10/1992 Uchida et al. ..... 345/89
5,376,944 * 12/1994 Mogi et al. ..... 345/100
5,448,257 * 9/1995 Margeson, III et al. ..... 345/3
5,512,915 * 4/1996 Leroux ..... 345/55
5,523,773 * 6/1996 Arakawa et al. ..... 345/98
5,600,344 * 2/1997 Sono et al. ..... 345/87
5,617,113 * 4/1997 Prince ..... 345/103
5,663,745 * 9/1997 Ishikawa et al. ..... 345/98
5,838,385 * 11/1998 Reder et al. ..... 348/565

FOREIGN PATENT DOCUMENTS

05260297 * 10/1993 (JP) .

* cited by examiner

*Primary Examiner*—Bipin Shalwala
*Assistant Examiner*—Ricardo Osorio
(74) *Attorney, Agent, or Firm*—Fleshner & Kim, LLP

(57) ABSTRACT

A system for driving a high-resolution LCD an a method thereof achieve high resolution by dividing input signals into signals of left and right parts of a LCD panel, by using general video processors. The system according to the present invention includes: a signal converting unit receiving horizontal and vertical synchronous signals and video signals and sampling and dividing the video signals to odd-numbered and even-numbered digital signals; a controlling unit outputting control signals so as for the video signals to be outputted in accordance with the previously set specification of a display; first and second processing means for separating and processing signals corresponding to left and right parts, respectively, of the display from the odd-numbered and even-numbered digital signals in accordance with the control signals; and a display driver driving the display in accordance with the signals from the first and second processing means.

20 Claims, 3 Drawing Sheets

SYSTEM FOR DRIVING HIGH-RESOLUTION DISPLAY PANEL AND METHOD THEREOF

BACKGROUND OF THE INVENTION

1. Field of the Invention

The present invention relates to a liquid crystal display (LCD) system, and more particularly to a system for driving a high-resolution LCD and a method thereof.

2. Description of the Conventional Art

Generally, a LCD driving system converts an analog video signal into a digital signal by applying video signals and synchronous signals, and by expanding, reducing or interpolating the digital signal, outputs the digital signal to a LCD monitor (such as a flat panel display). As demand for the LCD monitor increases, consumers also require a LCD monitor with higher resolution. Accordingly, efforts have been made for developing a novel video processor capable of realizing the high-resolution LCD monitor. A conventional LCD driving system is configured as shown in FIG. 1.

As shown in FIG. 1, the conventional LCD driving system is provided with an A/D converter 10 receiving analog video signals R, G, B and horizontal and vertical synchronous signals H, V and sampling the analog video signals R, G, B to thereby converting the analog video signals into digital signals, a phase locked loop (PLL) 14 receiving the horizontal and vertical synchronous signals H, V and outputting a signal having a predetermined frequency, a controlling unit 15 outputting a control signal so that the inputted video signals are outputted in accordance with the specification of a LCD panel 13 which has been previously set, a video processor 11 expanding, reducing or interpolating the digital signals in accordance with the control signal from the controlling unit 15 and a panel driver 12 driving the LCD 13 and receiving and outputting the signal processed in the video processor 11.

However, when applying a high-resolution input signal to a low-resolution LCD monitor, a high-frequency clock signal should be supplied to the A/D converter, video processor and panel driver. Therefore, it is difficult to select the elements fitted to such high-frequency clock signal for the conventional LCD driving system.

SUMMARY OF THE INVENTION

Accordingly, the present invention is directed to a system for driving a high-resolution LCD and a method thereof which obviate the problems and disadvantages in the conventional art.

An object of the present invention is to provide a system for driving a high-resolution LCD and a method thereof capable of achieving high resolution.

To achieve this object and other advantages and in accordance with the purpose of the present invention, as embodied and broadly described, according to a first embodiment, a system for driving a high-resolution LCD samples and thus divides inputted analog video signals into odd-numbered and even-numbered digital signals by using a pair of A/D converters which receive a clock signal at a predetermined frequency which is supplied from a PLL which receives horizontal and vertical synchronous signals of the inputted analog video signal. Here, the system divides the odd-numbered digital signals outputted from one of the A/D converters into odd-numbered digital signals of a left part of the LCD panel and odd-numbered digital signals of a right part thereof and stores the odd-numbered digital signals of the left and right parts thereof in first and third memory units, respectively, and also divides the even-numbered digital signals outputted from the other A/D converter into even-numbered digital signals of the left part of the LCD panel and even-numbered digital signals of the right part thereof and stores the even-numbered digital signals of the left and right parts thereof in second and fourth memory units, respectively, in accordance with a write/read signal outputted from a controller unit outputting control signals so as for the video signals to be outputted in accordance with a previously set specification of a LCD panel. Here, a first video processor receives and expands, reduces or interpolates the odd and even-numbered digital signals of the left part of the LCD panel and outputs the processed signals in accordance with the control signals from the controller unit, and a second video processor receives and expands, reduces or interpolates the odd and even-numbered digital signals of the right part thereof and outputs the processed signals in accordance with the control signals from the controller unit. Then, in accordance with the write/read signal from the controller unit, the system stores the odd-numbered and even-numbered digital signals of the left part of the LCD panel supplied from the first video processor in fifth and sixth memory units, respectively, while the system stores the odd-numbered and even-numbered digital signals of the right part thereof supplied from the second video processor in seventh and eighth memory units, respectively. Next, in accordance with the control signals from the controlling unit, the system continuously outputs the processed odd and even-numbered digital signals of the left part of the LCD panel and the processed odd and even-numbered digital signals of the right part thereof to a panel driver, for thereby driving the LCD panel.

According to a second embodiment of the present invention, a system for driving a high-resolution LCD is configured by including, further to the first embodiment, a first multiplexer which processes and outputs the processed odd-numbered digital signals of the left and right parts of the LCD panel outputted from the fifth and seventh memory units to the panel driver and a second multiplexer which receives and outputs the processed even-numbered digital signals of the left and right parts thereof outputted from the sixth and eighth memory units to the panel driver, the first and second multiplexers receiving a clock signal at a predetermined frequency supplied from the PLL as a referential frequency.

Further, according to a third embodiment of the present invention, there is provided a method for driving a high-resolution LCD which includes the steps of: sampling inputted analog video signals and thereby converting and dividing the inputted analog video signals into odd-numbered and even-numbered digital signals, the digital signals having half the frequency of the inputted analog video signals: storing the digital signals by dividing them into digital signals of left and right parts, respectively, of a LCD panel in accordance with a predetermined control signal: expanding, reducing or interpolating the odd and even-numbered digital signals of the left part and right part, respectively, of the LCD panel in accordance with the predetermined control signal; storing the thusly processed digital signals in accordance with the predetermined control signal; and multiplexing the processed signal to a panel driver to drive the LCD panel by reading the processed signals at twice the frequency of the previous storing step.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiment of the present invention, examples of which are illustrated in the accompanying drawings.

Figure 1:
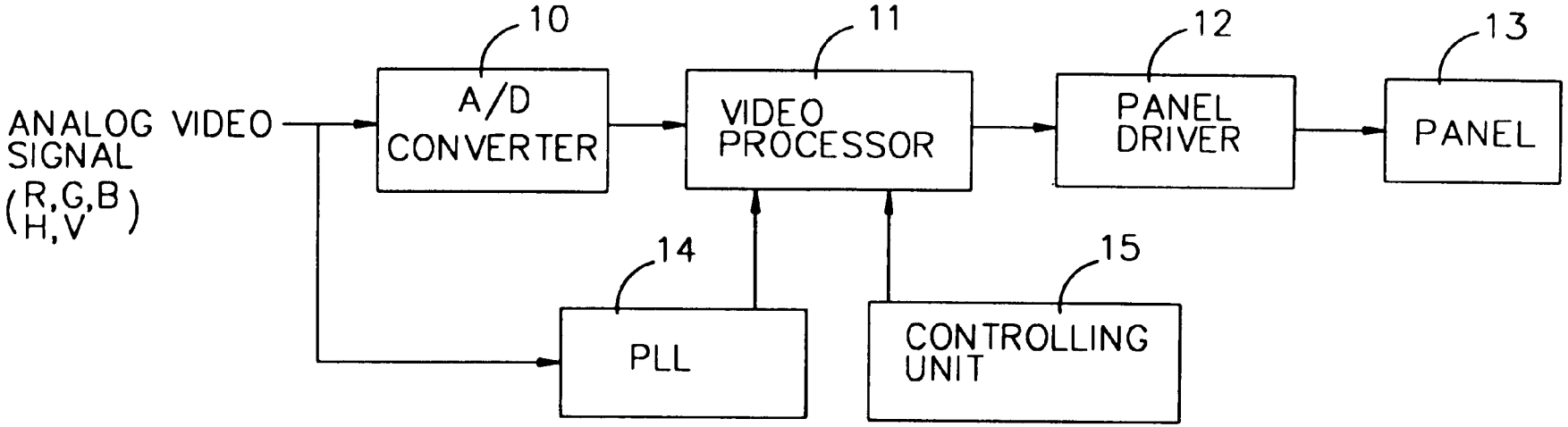
FIG. 1 CONVENTIONAL ART
FIG. 1 is a schematic block diagram illustrating a conventional LCD driving system.
Figure 2:
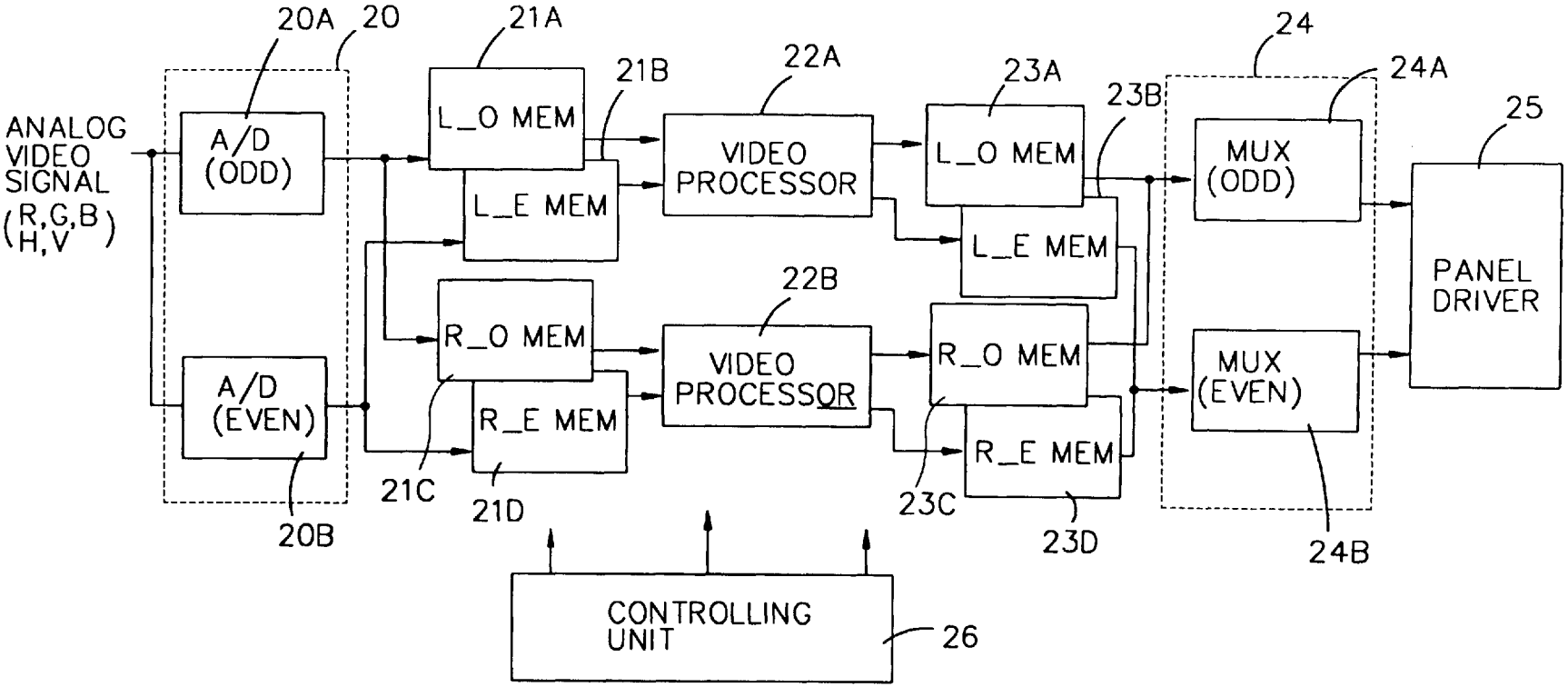
FIG. 2 is a schematic block diagram illustrating a system for driving a high-resolution LCD according to the present invention.

FIG. 2 illustrates the high-resolution LCD driving system according to the present invention. As shown therein, the high-resolution LCD driving system includes: a signal converting unit 20 which, by reference of a clock signal outputted at a predetermined frequency from a PLL (not shown) which receives horizontal and vertical synchronous signals H, V, receives analog video signals R, G, B and the horizontal and vertical synchronous signals H, V and samples the analog video signals R, G, B to thereby output odd-numbered digital signals and even-numbered digital signals; a controlling unit 26 which outputs control signals to control the outputting of video signals in accordance with the specification of a LCD panel (not shown) which has been previously set; first and second memory units 21A, 21B which store and output the odd-numbered and even-numbered digital signals by dividing them into odd-numbered and even-numbered digital signals, respectively, of a left part of the LCD panel in accordance with write/read signals from the controlling unit 26; third and fourth memory units 21C, 21D which store and output the odd-numbered and even-numbered digital signals by dividing them into odd-numbered and even-numbered digital signals, respectively, of a right part of the LCD panel in accordance with write/read signals from the controlling unit 26; a first video processor 22A which receives and then expands, reduces or interpolates the odd-numbered and even-numbered digital signals of the left part of the LCD panel, in accordance with the control signal from the controlling unit 26, and outputs the processed odd-numbered and even-numbered digital signals thereof; a second video processor 22B which receives and then expands, reduces or interpolates the odd-numbered and even-numbered digital signals of the right part of the LCD panel, in accordance a the control signal from the controlling unit 26, and outputs the processed odd-numbered and even-numbered digital signals thereof; fifth and sixth memory units 23A, 23B which store and output the processed odd-numbered and even-numbered digital signals, respectively, of the left part of the LCD panel in accordance with the write/read signals from the controlling unit 26; seventh and eighth memory units 23C, 23D which store and output the processed odd-numbered and even-numbered digital signals, respectively, of the right part of the right part of the LCD panel in accordance with the write/read signals from the controlling unit 26; and a panel driver 25 which, in accordance with a control signal from the controlling unit 26, receives the resultant odd-numbered and even-numbered digital signals of the left and right parts of the LCD panel and thereby drives the LCD panel. Here, it is noted that the signal converting unit 20 consists of a first A/D converter 20A which receives the analog video signals and outputs the odd-numbered digital signals and a second A/D converter 20B which also receives the analog video signals and outputs the even-numbered digital signals.

More specifically, the controlling unit 26 is configured with a write/read signal generator which outputs write/read signals to control the first, second, fifth and sixth memory units 21A, 21B, 23A, 23B which store the signals of the left part of the LCD panel and the third, fourth, seventh and eighth memory units 21C, 21D, 23C, 23D which store the signals of the right part of the LCD panel, a position signal generator which outputs a control signal to control the point in time at which write or read signals are applied to the first, second, fifth and sixth memory units 21A, 21B, 23A, 23B which store the signals of the left part of the LCD panel and to the third, fourth, seventh and eighth memory units 21C, 21D, 23C, 23D which store the signals of the right part of the LCD panel, and a synchronous signal generator which outputs digital horizontal and vertical synchronous signals generated by converting the inputted analog horizontal and vertical synchronous signals H, V to control the operation of the video processors.

Further, according to another embodiment of the present invention, first and second multiplexers can be added to the above-described embodiment of the high-resolution LCD driving system, by using the clock signal at a predetermined frequency outputted from the PLL (not shown) which receives the horizontal and vertical synchronous signals H, V as a referential frequency, the first multiplexer 24A receiving the odd-numbered digital signals of the left and right parts of the LCD panel which are supplied from the fifth and seventh memory units 23A, 23C, respectively, and outputting the resultant odd-numbered digital signals to the panel driver 25, and the second multiplexer 24B receiving the even-numbered digital signals of the left and right parts of the LCD panel which are supplied from the sixth and eighth memory units 23B, 23D, respectively, outputting the resultant even-numbered digital signals to the panel driver 25.

Now, with reference to FIGS. 3A through 3H, the operation of the LCD driving system according to the present invention will be described.

Figures 3A, 3B, 3C, 3D, 3E, 3F, 3G, 3H:
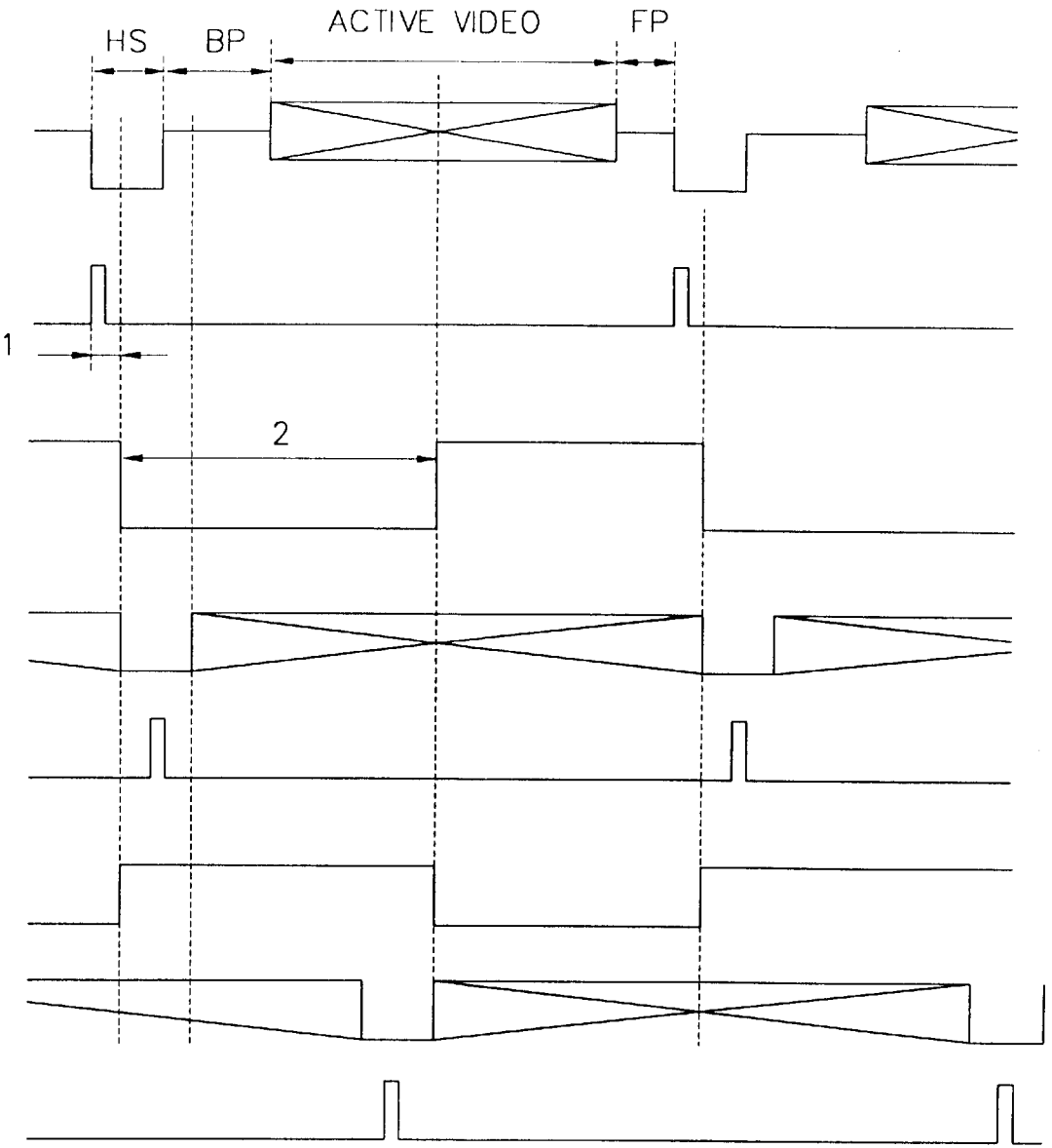
FIGS. 3A through 3H are input/output timing diagrams of functional blocks in the system for driving the LCD of FIG. 2.

First, the signal converting unit 20, consisting of the pair of A/D converters 20A, 20B, which receive the analog video signals R, G, B and the horizontal and vertical synchronous signals H, V output the odd-numbered or even-numbered digital signals as shown in FIG. 3A, the digital signals having half the frequency of the analog video signals R, G, B. Here, FIG. 3A illustrates a signal from the first A/D converter 20A which outputs the odd-numbered digital signals, wherein on the basis of an active video signal HS indicates the width of the horizontal synchronous signal, BP indicates the width of a back porch and FP indicates the width of a front porch.

The controlling unit 26 receives the horizontal and vertical synchronous signals and generates a referential synchronous signal, as shown in FIG. 3B. So as for the high-resolution LCD driving system according to the present invention to divide and store the signals supplied from the signal converting unit 20 in the first and third memory units 21A, 21C, respectively, a counter (not shown) of the controlling unit 26 counts on the basis of a rising edge of the referential synchronous signal in FIG. 3B (for example, the interval marked as 1) and outputs a position control signal to enable the first and third memory units 21A, 21C. Then, during a low-level period of the position control signal which is shown as the interval 2 of FIG. 3C, the controlling unit 26 outputs the write/read signal to control the signals outputted from the signal converting unit 20 to be stored in the first memory unit 21A.

Similarly, the control signal for storing the odd-numbered digital signals of the right part of the LCD panel and supplied to the third memory unit 21C, as shown in FIG. 3F, has an opposite polarity to the position control signal in FIG. 3C which controls the first memory unit. Accordingly, the odd-numbered digital signals of the left and right parts of the LCD panel are alternately written in the first and third memory units, respectively.

In addition, the controlling unit 26 generates and outputs a horizontal synchronous signal of the left part of the LCD panel from the referential synchronous signal of FIG. 3B, as shown in FIG. 3E, to the first video processor 22A and also generates and outputs a horizontal synchronous signal of the right part of the LCD panel, as shown in FIG. 3H, to the second video processor 22B.

Here, to determine the start point of the active video signal of the inputted video signals and to compensate for the point in time when the active video signal is written in the memory units, the first video processor 22A expands the odd-numbered digital signal of the left part of the LCD panel in accordance with the horizontal synchronous signal of the left part thereof from the controlling unit 26, as shown in FIG. 3D, and the second video processor 22B expands the odd-numbered digital signal of the right part of the LCD panel in accordance with the horizontal synchronous signal of the right part of the LCD panel from the controlling unit 26, as shown in FIG. 3G.

While, the expanded digital signals, which are outputted from the video processors 22A, 22B, are stored in the fifth and seventh memory units 23A, 23C, respectively, the fifth and seventh memory units 23A, 23C being also controlled by the position control signal from the controlling unit 26 as are the first and third memory units 21A, 21C. The signals stored in the fifth and seventh memory units 23A, 23C are applied to the first multiplexer 24A which reads the inputted signals at twice the frequency of the write clock signal and drives the panel driver 25, so that the LCD panel can display the high-resolution image.

It is noted that although the above description is made only for the odd-numbered digital signals of the video signals, the same operation is also applied to the even-numbered digital signals thereof.

Further, as another embodiment of the present invention, the method for driving the high-resolution LCD includes the steps of: sampling inputted analog video signals and dividing the sampled video signals into odd-numbered digital signals and even-numbered digital signals, each of which having half the frequency of the inputted analog video signals; storing the odd and even-numbered digital signals by dividing them into digital signals of left and right parts, respectively, of the LCD panel in accordance with a predetermined control signal; expanding, reducing or interpolating the odd and even-numbered digital signals of the left part of the LCD panel and the odd and even-numbered digital signals of the right part thereof; storing the signals which have been previously processed in accordance with the predetermined control signal; and multiplexing to the panel driver to drive the LCD panel by reading the stored signals at twice the frequency in the previous step.

As described above, according to the present invention, the high-resolution image can be provided to the LCD panel by applying video processors which are generally used. In addition, although data are processed by being divided into the left and right parts of the LCD panel in the embodiment of the present invention, the data can be alternatively processed by being divided into upper and lower parts thereof in other preferred embodiments of the present invention.

It will be apparent to those skilled in the art that various modifications and variations can be made in the system for driving the high-resolution LCD and the method thereof of the present invention without departing from the spirit or scope of the invention. Thus, it is intended that the present invention cover the modifications and variations of this invention provided they come within the scope of the appended claims and their equivalents.

What is claimed is:

1. A system for driving a high-resolution display panel, comprising:

a signal converting unit for receiving horizontal and vertical synchronous signals and analog video signals and sampling and dividing the analog video signals into odd-numbered and even-numbered digital signals;

a controlling unit for outputting control signals so as for the video signals to be outputted in accordance with a previously set specification of a display panel;

first processing means for separating, processing and storing those digital signals corresponding to a left part of the display from the odd and even-numbered digital signals in accordance with the control signals;

second processing means for separating, processing and storing those digital signals corresponding to a right part of the display from the odd and even-numbered digital signals in accordance with the control signals; and a display driver for driving the display in accordance with the signals from the first and second processing means, wherein the first processing means comprises, first and second storing means for receiving storing and outputting the odd-numbered digital signals and the even-numbered digital signals, respectively, of the left part of the display in accordance with the control signals from the controlling unit, a first video processor for receiving and expanding the odd and even-numbered digital signals of the left part of the display and outputting the processed signals in accordance with the control signals from the controlling unit, and third and fourth storing means for storing and outputting the processed odd-numbered and even-numbered digital signals, respectively, of the left part of the display in accordance with the control signals from the controlling unit.

2. The system for driving the high-resolution display panel according to claim 1, wherein the signal converting unit consists of a first A/D converter which samples the inputted analog video signals and outputs the odd-numbered digital signals and a second A/D converter which also samples the inputted analog video signals and outputs the even-numbered digital signals, each converter operating in accordance with a signal at a predetermined frequency outputted from a PLL which receives horizontal and vertical synchronous signals of the inputted analog video signals as a referential signal.

3. The system for driving the high-resolution display panel according to claim 1, wherein each of the odd and even-numbered digital signals has half the frequency of a sampling frequency of the signal converting unit.

4. The system for driving the high-resolution display panel according to claim 1, wherein the signal converting unit is operated by a clock signal at a predetermined frequency outputted from a PLL which receives horizontal and vertical synchronous signals of the inputted analog video signals.

5. The system for driving the high-resolution display panel according to claim 1, wherein the display is a LCD display.

6. The system for driving the high-resolution display panel according to claim 1, wherein the controlling unit comprises:

a synchronous signal detecting means for detecting synchronous signals from the horizontal and vertical synchronous signals of the inputted analog video signals;

a position signal generating means for generating a position control signal which controls a point in time of writing or reading the signals corresponding to the left and right parts, respectively, of the display to/from the first and second processing means, respectively, in accordance with the synchronous signals detected by the synchronous signal detecting means;

a write/read signal generating means for outputting a write/read signal to the first and second processing means after a predetermined time from which the position control signal has been generated; and a synchronous signal generating means for generating horizontal and vertical synchronous signals of the digital signals of the left and right parts of the display from the synchronous signals detected by the synchronous signal detecting means.

7. The system for driving the high-resolution display panel according to claim 6, wherein when the storing means which store the digital signals corresponding to the left and right parts, respectively, are in an active state, the write/read signal is at a low level or a high level.

8. The system for driving the high-resolution display panel according to claim 7, wherein the signals stored in the third and fourth storing means are read by a clock signal which has half the frequency of a clock signal which controls the signals in the first and second storing means.

9. The system for driving the high-resolution display panel according to claim 8, wherein the first video processor receives and reduces or interpolates the odd-numbered and even-numbered digital signals of the left part of the display in accordance with the control signals from the controlling unit.

10. The system for driving the high-resolution display panel according to claim 1, wherein the second processing means comprises:

fifth and sixth storing means for receiving, storing and outputting the odd-numbered digital signals and the even-numbered digital signals, respectively, of the right part of the display in accordance with the control signals from the controlling unit;

a second video processor for receiving and expanding the odd-numbered and even-numbered digital signals of the right part of the display and outputting the processed signals in accordance with the control signals from the controlling unit; and seventh and eighth storing means for storing and outputting the processed odd-numbered and even-numbered digital signals, respectively, of the right part of the display in accordance with the control signals from the controlling unit.

11. The system for driving the high-resolution display panel according to claim 10, wherein the signals stored in the seventh and eighth storing means are read by a clock signal which has half the frequency of a clock signal which controls the signals in the fifth and sixth storing means.

12. The system for driving the high-resolution display panel according to claim 10, wherein the second video processor receives and reduces or interpolates the odd-numbered and even-numbered digital signals of the right part of the display in accordance with the control signals from the controlling unit.

13. The system for driving the high-resolution display panel according to the claim 1, further comprising:

a first multiplexer for receiving and outputting the processed odd-numbered digital signals of the left and right parts of the display outputted from the first and second processing means to the display driver; and a second multiplexer for receiving and outputting the processed even-numbered digital signals of the left and right parts of the display outputted from the first and second processing means to the display driver, the first and second multiplexers receiving a clock signal at a predetermined frequency.

14. A method for driving a high-resolution display panel, comprising:

inputting analog horizontal and vertical synchronous signals and video signals and dividing the analog video signals into odd-numbered digital signals and even-numbered digital signals by sampling;

performing a first process to separate the odd and even-numbered digital signals corresponding to a left part of a display which has been previously set in accordance with a predetermined control signal;

performing a second process to separate the odd and even-numbered digital signals corresponding to a right part of the display in accordance with the predetermined control signal; and driving the display in accordance with signals generated in the first and second processes, wherein the first process comprises, first and second storing steps for receiving, storing and outputting the odd-numbered digital signals and the even-numbered digital signals, respectively, of the left part of the display in accordance with the control signal, a first video processing step for receiving and expanding the odd and even-numbered digital signals of the left part of the display and outputting the thusly processed signals in accordance with the control signal, and third and fourth storing steps for storing and outputting the previously processed odd-numbered and even-numbered digital signals, respectively, of the left part of the display in accordance with the control signal.

15. The method for driving the high-resolution display panel according to claim 14, wherein the second process comprises:

fifth and sixth storing steps for receiving, storing and outputting the odd-numbered digital signals and the even-numbered digital signals, respectively, of the right part of the display in accordance with the control signal;

a second video processing step for receiving and expanding the odd and even-numbered digital signals of the right part of the display and outputting the thusly processed signals in accordance with the control signal; and seventh and eighth storing steps for storing and outputting the previously processed odd-numbered and even-numbered digital signals, respectively, of the right part of the display in accordance with the control signal.

16. The method for driving the high-resolution display panel according to claim 14, further comprising:

a first multiplexing step for receiving and outputting the processed odd-numbered digital signals of the left and right parts of the display from the first and second processes to the display driver; and a second multiplexing step for receiving and outputting the processed even-numbered digital signals of the left and right parts of the display outputted from the first and second processes to the display driver, the first and second multiplexing steps being controlled by a clock signal at a predetermined frequency.

17. A system for driving a high-resolution display panel, comprising:

a signal converting unit for receiving horizontal and vertical synchronous signals and analog video signals and sampling and dividing the analog video signals into odd-numbered and even-numbered digital signals;

a controlling unit for outputting control signals so as for the video signals to be outputted in accordance with a previously set specification of a display panel;

first processing means for separating, processing and storing those digital signals corresponding to a left part of the display from the odd and even-numbered digital signals in accordance with the control signals;

second processing means for separating, processing and storing those digital signals corresponding to a right part of the display from the odd and even-numbered digital signals in accordance with the control signals; and a display driver for driving the display in accordance with the signals from the first and second processing means, wherein the controlling unit comprises, synchronous signal detecting means for detecting synchronous signals from the horizontal and vertical synchronous signals of the inputted analog video signals, position signal generating means for generating a position control signal which controls a point in time of writing or reading the signals corresponding to the left and right parts, respectively, of the display to/from the first and second processing means, respectively, in accordance with the synchronous signals detected by the synchronous signal detecting means, write/read signal generating means for outputting a write/read signal to the first and second processing means after a predetermined time from which the position control signal has been generated, and synchronous signal generating means for generating horizontal and vertical synchronous signals of the digital signals of the left and right parts of the display from the synchronous signals detected by the synchronous signal detecting means.

18. A system for driving a high-resolution display panel, comprising:

a signal converting unit for receiving horizontal and vertical synchronous signals and analog video signals and sampling and dividing the analog video signals into odd-numbered and even-numbered digital signals;

a controlling unit for outputting control signals so as for the video signals to be outputted in accordance with a previously set specification of a display panel;

first processing means for separating, processing and storing those digital signals corresponding to a left part of the display from the odd and even-numbered digital signals in accordance with the control signals;

second processing means for separating, processing and storing those digital signals corresponding to a right part of the display from the odd and even-numbered digital signals in accordance with the control signals; and a display driver for driving the display in accordance with the signals from the first and second processing means, wherein the second processing means comprises, fifth and sixth storing means for receiving, storing and outputting the odd-numbered digital signals and the even-numbered digital signals, respectively, of the right part of the display in accordance with the control signals from the controlling unit, a second video processor for receiving and expanding the odd-numbered and even-numbered digital signals of the right part of the display and outputting the processed signals in accordance with the control signals from the controlling unit, and seventh and eighth storing means for storing and outputting the processed odd-numbered and even-numbered digital signals, respectively, of the right part of the display in accordance with the control signals from the controlling unit.

19. A method for driving a high-resolution display panel, comprising:

inputting analog horizontal and vertical synchronous signals and video signals and dividing the analog video signals into odd-numbered digital signals and even-numbered digital signals by sampling;

performing a first process to separate the odd and even-numbered digital signals corresponding to a left part of a display which has been previously set in accordance with a predetermined control signal;

performing a second process to separate the odd and even-numbered digital signals corresponding to a right part of the display in accordance with the predetermined control signal;

driving the display in accordance with signals generated in the first and second processes, wherein the second process comprises, fifth and sixth storing steps for receiving, storing and outputting the odd-numbered digital signals and the even-numbered digital signals, respectively, of the right part of the display in accordance with the control signal, a second video processing step for receiving and expanding the odd and even-numbered digital signals of the right part of the display and outputting the thusly processed signals in accordance with the control signal, and seventh and eighth storing steps for storing and outputting the previously processed odd-numbered and even-numbered digital signals, respectively, of the right part of the display in accordance with the control signal.

20. A system for driving a high-resolution display panel, comprising:

a signal converting unit for receiving horizontal and vertical synchronous signals and analog video signals and sampling and dividing the analog video signals into odd-numbered and even-numbered digital signals;

a controlling unit for outputting control signals so as for the converted video signals to be outputted in accordance with a previously set specification of a display panel;

first and second storing means for receiving, storing and outputting the odd-numbered digital signals and the even-numbered digital signals, respectively, of a left part of the display panel in accordance with the control signals from the controlling unit;

a first video processor for receiving and expanding the odd and even-numbered digital signals of the left part of the display and outputting the processed signals in accordance with the control signals from the controlling unit;

third and fourth storing means for storing and outputting the processed odd-numbered and even-numbered digital signals, respectively, of the left part of the display panel in accordance with the control signals from the controlling unit;

fifth and sixth storing means for receiving, storing and outputting the odd-numbered digital signals and the even-numbered digital signals, respectively, of a right part of the display panel in accordance with the control signals from the controlling unit;

a second video processor receives and reduces or interpolates the odd-numbered and even-numbered digital signals of the right part of the display panel in accordance with the control signals from the controlling unit;

seventh and eighth storing means for storing and outputting the processed odd-numbered and even-numbered digital signals, respectively, of the right part of the display panel in accordance with the control signals from the controlling unit;

a first multiplexer for multiplexing the odd-numbered digital signals of the left and right parts of the display panel from the third and seventh memory units and outputting the multiplexed odd-numbered digital signals;

a second multiplexer for receiving the even-numbered digital signals of the left and right parts of the display panel from the fourth and eighth memory units and outputting the multiplexed even-numbered digital signals; and a display driver for driving the display panel in accordance with the odd-numbered and even-numbered digital signals from the first and second multiplexers.

* * * * *